US008285185B2

(12) United States Patent
Sasaki et al.

(10) Patent No.: US 8,285,185 B2
(45) Date of Patent: Oct. 9, 2012

(54) FIXING DEVICE AND IMAGE FORMING APPARATUS USING THE SAME

(75) Inventors: Kosuke Sasaki, Toyokawa (JP); Toru Kasamatsu, Hachioji (JP); Tadayuki Ueda, Kokubunji (JP); Yoshihito Sasamoto, Hachioji (JP); Satoshi Miyajima, Hino (JP)

(73) Assignee: Konica Minolta Business Technologies, Inc, Tokyo (JP)

( * ) Notice: Subject to any disclaimer, the term of this patent is extended or adjusted under 35 U.S.C. 154(b) by 224 days.

(21) Appl. No.: 12/874,115

(22) Filed: Sep. 1, 2010

(65) Prior Publication Data

US 2011/0064442 A1 Mar. 17, 2011

(30) Foreign Application Priority Data

Sep. 11, 2009 (JP) ..... 2009-210244

(51) Int. Cl.
*G03G 15/20* (2006.01)

(52) U.S. Cl. ..... 399/333; 399/334

(58) Field of Classification Search ..... 219/216; 399/328, 333, 334

See application file for complete search history.

(56) References Cited

U.S. PATENT DOCUMENTS

| | | | | |
|---|---|---|---|---|
| 7,991,340 | B2 * | 8/2011 | Qi et al. | 399/333 |
| 8,045,910 | B2 * | 10/2011 | Choi et al. | 399/333 |
| 2006/0292360 | A1 * | 12/2006 | Hays et al. | 428/323 |

FOREIGN PATENT DOCUMENTS

| | | | |
|---|---|---|---|
| JP | 2007-304374 | A | 11/2007 |
| JP | 2008-180965 | A | 8/2008 |

* cited by examiner

*Primary Examiner* — Hoang Ngo

(74) *Attorney, Agent, or Firm* — Holtz, Holtz, Goodman & Chick, PC

(57) ABSTRACT

To enhance the fixing quality of a fixing device to continuously fix sheets of a plurality of sizes, a carbon nanotube sheet 75, in which a plurality of carbon nanotubes are arranged such that the longitudinal directions thereof are oriented in the same direction, is provided on the surface of a heating roller 70 so that the carbon nanotube sheet ranges from the position a predetermined distance inside and the position a predetermined distance outside of the position through which each of the both edges of a sheet P2 with smaller width dimension than a sheet P1 of the largest width dimension to be fixed passes.

9 Claims, 10 Drawing Sheets

FIXING DEVICE AND IMAGE FORMING APPARATUS USING THE SAME

This application is based on Japanese Patent Application No. 2009-210244 filed on Sep. 11, 2009, in Japanese Patent Office, the entire content of which is hereby incorporated by reference.

TECHNICAL FIELD

The present invention relates to a fixing device and an image forming apparatus, and more specifically to a fixing device enabling to prevent occurrence of a rapid drop of the surface temperature of a heating member, and an image forming apparatus provided with the fixing device.

BACKGROUND

Conventionally, in an image forming apparatus such as a laser printer or a copying machine, there has been used a fixing device to melt and fix a toner image formed on the surface of a sheet with toner. Such a fixing device is provided with a heating roller having a halogen heater as a heating member arranged in the interior thereof and a pressure roller pressed against that heating roller.

Heat of such a heating roller is lost by sheets, and nonuniformity occurs in the surface temperature, resulting in a factor of fixing nonuniformity. Under such a circumstance, to uniform the surface temperature of the heating roller, there are known rollers whose entire surface is provided with a surface layer mixed with carbon nanotubes (for example, refer to Unexamined Japanese Patent Application Publication No. 2007-304374). That surface layer is a composite of a mixture of a fluorine resin as a base material and carbon nanotubes or carbon nanofibers as filler.

As another heating roller, known is a heating roller provided with a coating layer on the roller surface in which carbon nanotubes are dispersed and blended so that the longitudinal directions thereof is arranged in the radius direction of the roller (for example, refer to Unexamined Japanese Patent Application Publication No. 2008-180965).

SUMMARY

In view of forgoing, an embodiment reflecting one aspect of the present invention is (1) a fixing device comprising a pair of fixing circular members for conveying a sheet while pinching the sheet between a fixing nip formed between the fixing circular members, and fixing, by heating, an unfixed toner image formed on the sheet onto the sheet, at least one of the circular member being a circular heating member on an outer circumferential surface of which is provided with a first carbon nanotube group which is made of a plurality of carbon nanotubes oriented in one of the following direction: a rotation axis direction of the circular heating member, a circumferential direction of the circular heating member; and a combined direction of the rotation axis direction and the circumferential direction.

In view of another aspect of the present invention, another embodiment is the fixing device of above item (1), wherein the fixing nip is configured to be supplied with at least two sizes of sheets, a first sheet feeding area on the circular heating member where a sheet having a wider width touches the circular heating member and a second sheet feeding area on the circular heating member where a sheet having a narrower width touches the circular heating member overlap each other, and an area where the carbon nanotube group is disposed includes an internal portion of both edges of the first sheet feeding area and an internal area of both edges of the second sheet feeding area In view of another aspect of the present invention, another embodiment is the fixing device of above item (1), wherein the fixing nip is configured to be supplied with at least two sizes of sheet, a first sheet feeding area on the circular heating member where a sheet with a wider width touches the circular heating member and a second sheet feeding area on the circular heating member where a sheet having a narrower width touches the circular heating member overlap each other, and an area where the carbon nanotube group is disposed includes an external portion of both edges of the first sheet feeding area and an internal area of both edges of the second sheet feeding area.

In view of another aspect of the present invention, another embodiment is the fixing device of above item (1), comprising:

a second carbon nanotube group which is provided on the circular heating member and is made of a plurality of carbon nanotubes oriented in a direction different from the orientation direction of first carbon nanotube group.

DETAILED DESCRIPTION OF THE PREFERRED EMBODIMENT

An image forming apparatus, to which a fixing device according to each embodiment of the present invention is applied, will now be detailed with reference to the drawings.

However, it should be noted that the drawings of the surface layer of a heating roller are only schematic, and the thickness and the dimensional ratio of each layer differ from those of an actual one. Further, some dimensional relationships and ratios between the drawings are different from the actual ones.

(First Embodiment)

Figure 1:
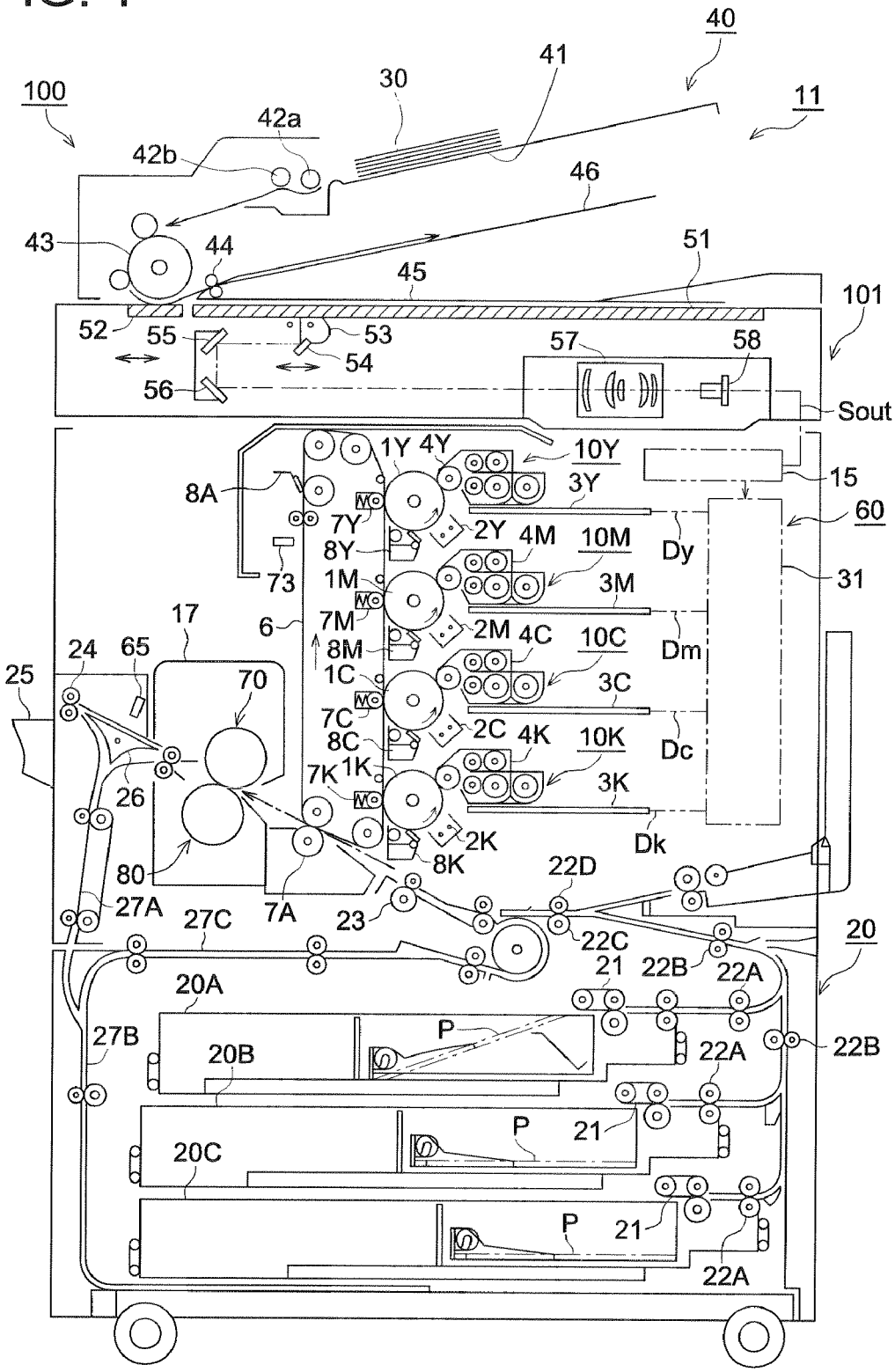
FIG. 1 is a schematic constitutional view of an image forming apparatus according to a first embodiment of the present invention.

FIG. 1 is an entire constitutional view showing the outline of a color copying machine as an image forming apparatus to which a fixing device according to a first embodiment of the present invention is applied. With reference to FIG. 1, the interior constitution of the color copying machine according to the first embodiment is schematically described below. Herein, the color copying machine of the present embodiment is referred to as a tandem-type color image forming apparatus.

The color copying machine is an apparatus in which a color image formed on an original document 30 is read to acquire the image information; and based on this image information, an image of each color is formed on a photosensitive drum, and thereafter an image in which the colors are superimposed on a sheet is formed. Herein, such an image formed on a sheet output from the color copying machine is referred to as an "output image." Incidentally, the image forming apparatus of the present invention may be applied to any of a color copying machine as described in the present embodiment such as a B/W copying machine, a color or B/W printer, and a facsimile machine, as well as a multifunction peripheral.

In the color copying machine, in the upper portion of a main body 101, an image input section 11 and an ADF 40 (an automatic document conveyance device) are arranged. The ADF 40 operates to automatically feed one or a plurality of original documents 30 in the automatic feed mode (ADF mode). Herein, the ADF mode is an operation in which an original document 30 placed in the ADF 40 is automatically fed, and an original image is then automatically read.

The ADF 40 has a document placing section 41, a roller 42*a*, a roller 42*b*, a roller 43, a conveying roller 44, and a sheet discharging tray 46. On the document placing section 41, one or a plurality of original documents 30 are placed. On the downstream side of the document placing section 41, the roller 42*a* and the roller 42*b* are provided. When the ADF mode is selected, the original document 30 having been discharged from the document placing section 41 is conveyed so as to rotate in a U-shaped manner by the roller 43 of the downstream side. Herein, in the case of selection of the ADF mode, the original document 30 is placed with its recording surface up in the document placing section 41.

Further, the image input section 11 operates to read a color image formed on the original document 30. For the image input section 11, for example, a color slit scan-type scanner is used. In the image input section 11, an image sensor 58 having an array arrangement is provided. For example, in the ADF mode, when an original document 30 is reversed in a U-shaped manner by the roller 43, the surface of the original document 30 is read and output as an image reading signal Sout.

For the image sensor 58, for example, a 3-line color CCD (Charged Coupled Device) imaging device is used The image sensor 58 is provided with 3 reading sensors each for light detection of red (R), green (G), and blue (B) colors constituted in such a manner that a plurality of light receiving element arrays are arranged in the main scanning direction. The 3 reading sensors divide a pixel into different portions in the vertical scanning direction perpendicular to the main scanning direction so as to simultaneously read light information of R color, G color, and B color.

The original document 30 having been read by the image input section 11 is conveyed by the conveying roller 44 to be discharged to the sheet discharging tray 46. Further, in the platen mode the image sensor 58 outputs RGB color-based image reading signals having been obtained by reading the original document 30. Herein, the platen mode is an operation in which a document image is automatically read by scanning of the original document 30 placed on a platen glass using an optical drive system.

The image input section 11 has, other than the image sensor 58, a first platen glass 51, a second platen glass 52 (an ADF glass), a light source 53, mirrors 54, 55, and 56, and an image focusing optical section 57, as well as an unshown optical drive section. This optical drive section operates to relatively move an original document 30 or the image sensor 58 in the vertical scanning direction. The vertical scanning direction is the direction perpendicular to the main scanning direction, provided that a plurality of light receiving elements constituting the image sensor 58 are arranged in the main scanning direction. The mirrors 54-56 are arranged so as to reflex light reflected by the original document 30. The image focusing optical section 57 focuses the reflexed light on the image sensor 58. In such a manner, the original document 30 placed in the document placing section 41 of the ADF 40 is conveyed by the rollers 42*a*, 42*b*, 43, and the conveying roller 44 described above, and then an image of one side or both sides of the original document 30 is scanned and exposed by the optical system (including the light source 53, mirrors 54, 55, and 56, the image focusing optical section 57, and the optical drive section) of the image input section 11. Thereafter, reflected light reflecting the image information of the original document 30 is read by the image sensor 58.

The image sensor 58 conducts photoelectric conversion based on the light intensity of the incident light. An analog image reading signal having been photoelectrically converted is subjected to A/D conversion within the image input section 11 to be output as a digital image reading signal Sout from the image input section 11. The image input section 11 is connected to an image processing section 31 through a control section 15. In the image processing section 31, the digital image reading signal Sout is subjected to image compression processing and variable magnification processing to result in digital image data of the R color, G color, and B color components. Further, the image processing section 31 converts the image data into image data Dy, Dm, Dc, and Dk for Y, M, C, and BK colors based on a 3-dimentional color information conversion table. Then, the image data Dy, Dm, Dc, and Dk after the color conversion are transferred to writing units 3Y, 3M, 3C, and 3K constituting an image forming section 60.

The image forming section 60 forms a color image based on the image data Dy, Dm, Dc, and Dk having been obtained by reading with the image input section 11. The image forming section 60 is provided with a plurality of image forming units 10Y, 10M, 10C, and 10K each having a photosensitive drum for each color of Y, M, C, and BK, as well as an intermediate transfer body 6. Herein, this color copying machine has only one image forming section 60, and the image forming section 60 serves as the image forming section of the most downstream position. Further, on the downstream side of the image forming section 60, provided is a fixing device 17 to fix a toner image transferred from the intermediate transfer body 6 onto a sheet. Incidentally, this fixing device 17 will be detailed later.

The image forming unit 10Y, forming a yellow (Y) image, has a photoreceptor drum 1Y as an image forming body to form a Y color toner image and a Y color charging section 2Y, writing unit 3Y, and developing section 4Y, as well as a cleaning section 8Y for the image forming body arranged in the periphery of the photoreceptor drum 1Y. The image forming unit 10M, forming a magenta (M) image, has a photoreceptor dram 1M as an image forming body to form a M color toner image and a M color charging section 2M, writing unit 3M, and developing section 4M, as well as a cleaning section 8M for the image forming body. The image forming unit 10C, forming a cyan (C) image, has a photoreceptor drum 1C as an image forming body to form a C color toner image and a C color charging section 2C, writing unit 3C, and developing section 4C, as well as a cleaning section 8C for the image forming body. The image forming unit 10K, forming a black (BK) image, has a photoreceptor drum 1K as an image forming body to form a K color toner image and a BK color charging section 2K, writing unit 3K, and developing section 4K, as well as a cleaning section 8K for the image forming body.

The charging section 2Y and writing unit 3Y, the charging section 2M and writing unit 3M, the charging section 2C and writing unit 3C, and the charging section 2K and writing unit 3K each form an electrostatic latent image on each of the photoreceptor drums 1Y, 1M, 1C, and 1K based on image data Dy, Dm, Dc, and Dk. Each of the writing units 3Y, 3M, 3C, and 3K is a solid scanning-type writing unit in which a plurality of optical modulation elements are arranged in a line in the main scanning direction perpendicular to the conveyance direction (the vertical scanning direction) of a sheet on which an image is formed. In the present example, an LED array head optical system employing LED elements as optical modulation elements is used The developing sections 4Y, 4M, 4C, and 4K each develop an electrostatic latent image on the photoreceptor drums 1Y, 1M, 1C, and 1K to form toner images of Y color, M color, C color, and BK color. Development by the developing sections 4Y, 4M, 4C, and 4K is carried out in reverse development method in which an development bias, in which an AC voltage is superimposed on a DC bias having the same polarity as the toner, is employed.

The intermediate transfer body 6 is rotatably supported by a plurality of rollers. Primary transfer rollers 7Y, 7M, 7C, and 7K are placed at the positions opposed to the photoreceptor drums 1Y, 1M, 1C, and 1K so as to sandwich the intermediate transfer body 6. A primary transfer bias (not specifically shown) of an opposite polarity (for example, positive polarity) to that of toner to be used is applied to the primary transfer rollers 7Y, 7M, 7C, and 7K, whereby toner images of Y color, M color, C color, and BK color each formed on the photoreceptor drums 1Y, 1M, 1 C, and 1K are sequentially transferred onto the rotating intermediate transfer body 6. In this manner, a color toner image having been produced by superimposing the toner images of the individual colors is formed by the primary transfer.

Further, beneath the image forming section 60, a conveying section 20 is provided to operate to convey sheets P to the image forming section 60. The conveying section 20 has sheet feed trays 20A, 20B, and 20C to store sheets P. A sheet P stored in the sheet feed tray 20A is fed by discharging rollers 21 placed in the sheet feed tray 20A and sheet feed rollers 22A and passed through conveying rollers 22B, 22C, and 22D, and registration rollers 23, and then conveyed to a secondary transfer roller 7A, whereby the color toner image is secondarily transferred collectively from the intermediate transfer body 6 onto one side (surface) of the sheet P.

The fixing device 17 applies heat and pressure to the sheet P on which the color toner image has been transferred to fuse the toner on the sheet P for fixing. The sheet P after fixing is nipped with conveying rollers 24 and discharged onto the sheet discharging tray 25. The post-transfer residual toner remaining on the outer circumferential surfaces of the photoreceptor drums 1Y, 1M, 1C, and 1K after transfer is removed by the cleaning sections 8Y, 8M, 8C, and 8K to be used in the subsequent image forming cycle.

When images are to be formed on both sides of the sheet P, after one image is formed on one surface, the sheet P is discharged from the fixing device 17 and is branched off from the conveying path toward the sheet discharging tray 25 by a branch section 26. Subsequently, the sheet P is passed through a circulating sheet passing path 27A on the lower side, and then the front and rear sides thereof are reversed by a reversing conveying path 27B which is a re-paper-supply mechanism (ADU mechanism). Then, the sheet P is passed through a re-sheet feed conveying section 27C to join the above transfer path.

The sheet P, having been reversed and conveyed, is passed through the registration rollers 23 and again conveyed to the secondary transfer roller 7A. Then, color images (color toner images) are collectively transferred onto the rear surface of the sheet P. On the other hand, the color image is transferred onto the sheet P by the secondary transfer roller 7A, and thereafter the residual toners remaining on the intermediate transfer body 6 from which the sheet P has been curvature-separated are removed by the cleaning section 8A for the intermediate transfer belt.

An image quality level measurement section 65 is placed adjacent to the conveying path to convey the fixed sheet P. Outside the intermediate transfer body 6, a gamma curve measurement section 73 is placed at a position adjacent thereto. The image quality level measurement section 65 is provided with an image quality level measurement sensor. The gamma curve measurement section 73 has a gamma curve measurement sensor. The image quality level measurement sensor and the gamma curve measurement sensor each contain 4 reading sensors for light detection of yellow (Y) color, magenta (M) color, cyan (C) color, and black (BK) color.

The image quality level measurement section 65 operates to determine the image quality level of an output image output from the color copying machine. For example, the image quality level measurement sensor photoelectrically converts light reflected on one side of a sheet P, which is conveyed from the fixing device 17 to the sheet discharging tray 25, to acquire color data of an output image. The image quality level measurement section 65 determines, as the image quality level of the output image, the correlation between the (output) color data of the output image and image data Dy, Dm, Dc, and Dk (input) transferred to the writing units 3Y, 3M, 3C, and 3K based on the color data of the output image.

The gamma curve measurement section 73 operates to determine the image quality level of an intermediate image formed in the middle of a series of the image forming steps to form an output image. For example, the gamma curve measurement sensor acquires color data of a color toner image by photoelectrically converting light reflected on the outer circumferential surface of the intermediate transfer body 6. The gamma curve measurement section 73 determines, as the image quality level of the intermediate image, the correlation between the (output) color data of the color toner image and image data Dy, Dm, Dc, and Dk (input) transferred to the writing units 3Y, 3M, 3C, and 3K based on the color data of the color toner image. Herein, the image quality level of the intermediate image is corrected under the control of the control section 15.

In this case, color toner images formed on the intermediate transfer body 6 are described as one example of the intermediate image. However, other than this, employable is each of the toner images or electrostatic latent images of Y color, M color, C color, and BK color formed on the photoreceptor drums 1Y, 1M, 1C, 1K.

(Fixing Device)

Figure 2:
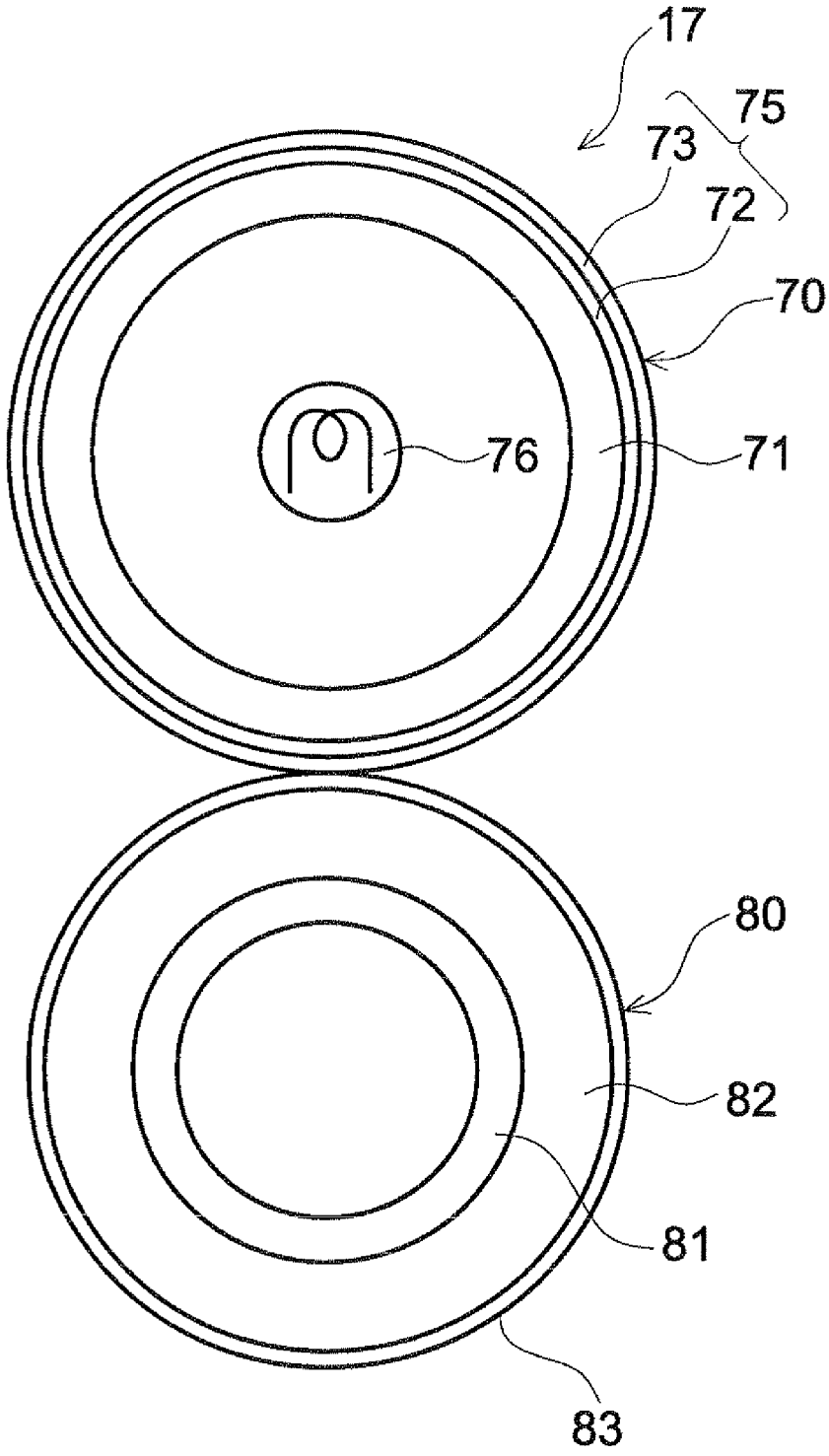
FIG. 2 is a side view showing a fixing device according to the first embodiment of the present invention.

As shown in FIG. 1 and FIG. 2, the fixing device 17 of the present embodiment is provided with a heating roller 70 as a circular heating member and a pressure roller 80 as a pressure rotating member. These heating roller 70 and pressure roller 80 constitute a fixing rotating member pair. Herein, the fixing device 17 of the present embodiment fixes two different size sheets, namely a sheet P1 with a larger width dimension W1 and a sheet P2 with a smaller width dimension.

Figure 5:
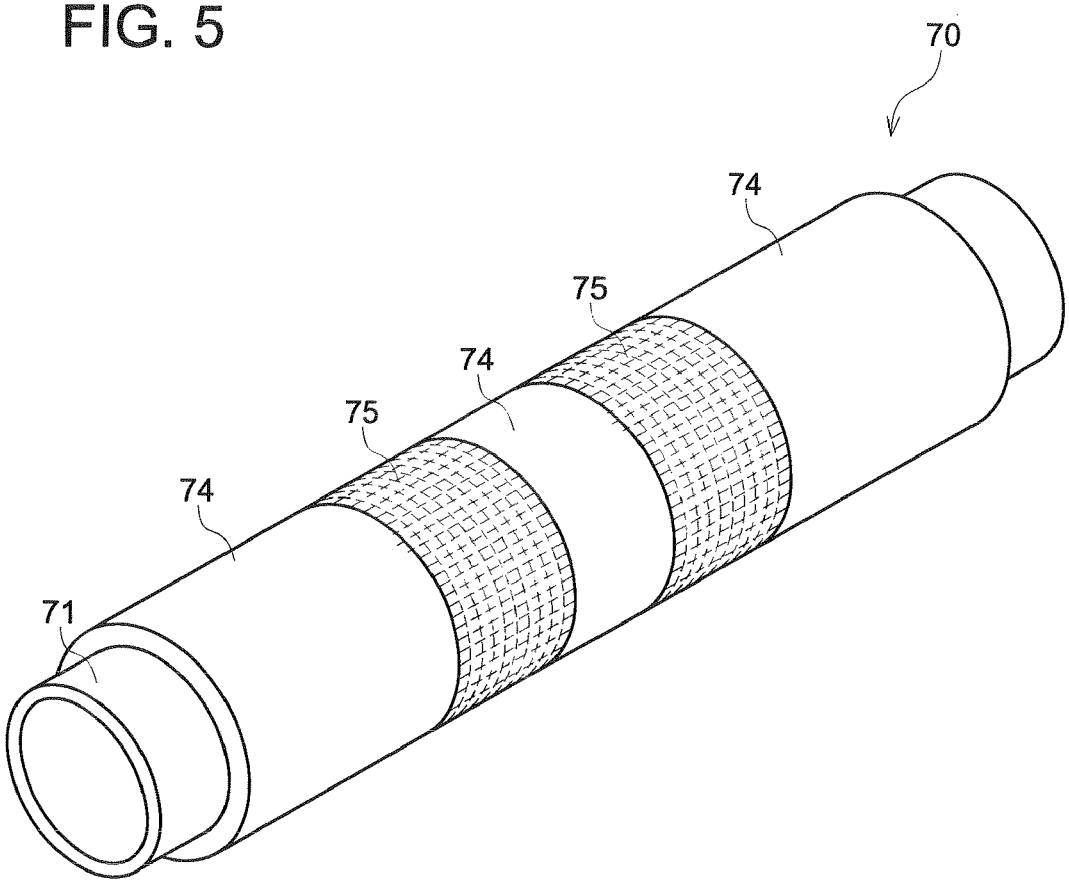
FIG. 5 is a perspective view of the heating roller of the fixing device according to the first embodiment of the present invention.

As shown in FIG. 2 and FIG. 5, the heating roller 70 is provided with a roller main body 71 formed of a metal such as aluminum or iron. Further, as shown in FIG. 2, in the interior of the roller main body 71, a halogen heater 76 is arranged as a heating member.

As shown in FIG. 5, on the surface of this roller main body 71, provided are belt-like coating layers 74 formed, in three areas, in the circumferential direction, which areas are on the both end portions of the roller and on the center portion of the roller; and carbon nanotube sheets 75 as carbon nanotube groups arranged in the areas between these coating layers 74.

Figure 4:
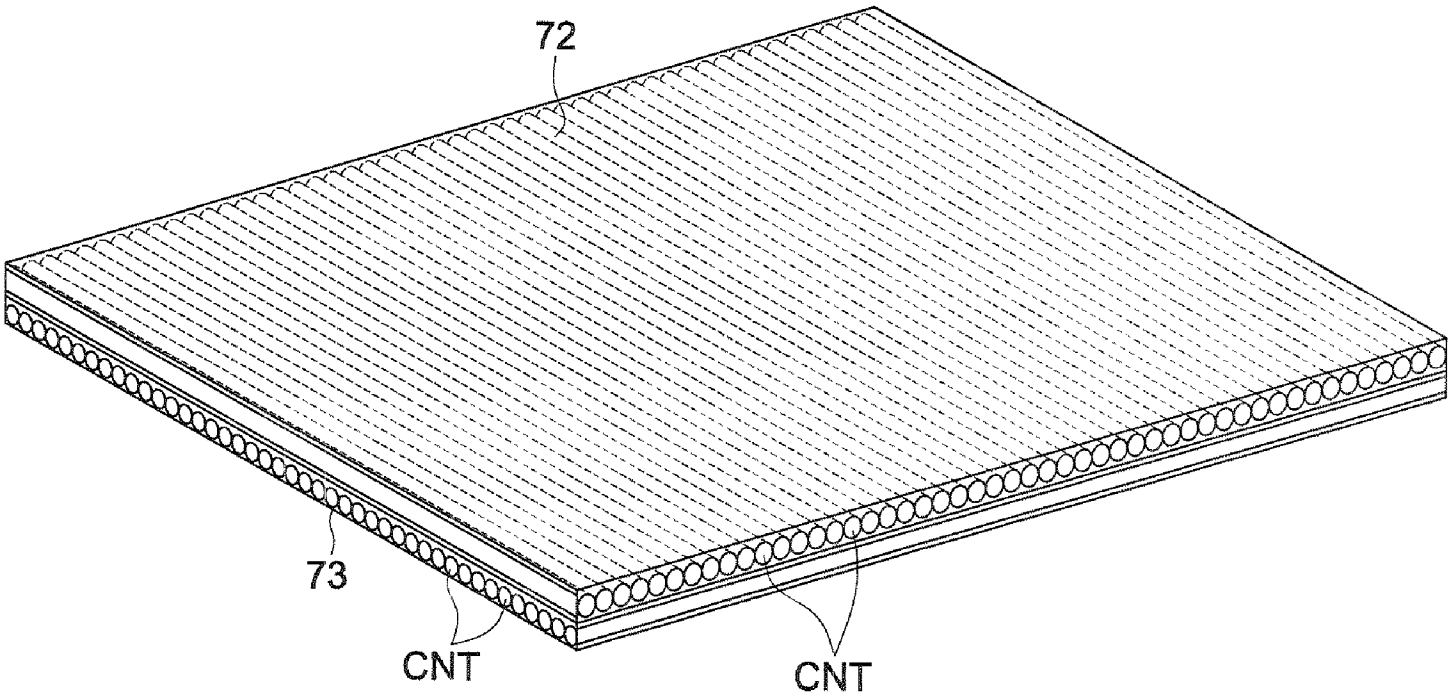
FIG. 4 is an illustrative view showing a carbon nanotube sheet of the heating roller for the fixing device according to the first embodiment of the present invention.

As shown in FIG. 2 and FIG. 4, the carbon nanotube sheets 75 are formed by sequentially laminating a lower carbon nanotube sheet 72 and an upper carbon nanotube sheet 73 each having the same width.

Figure 3:
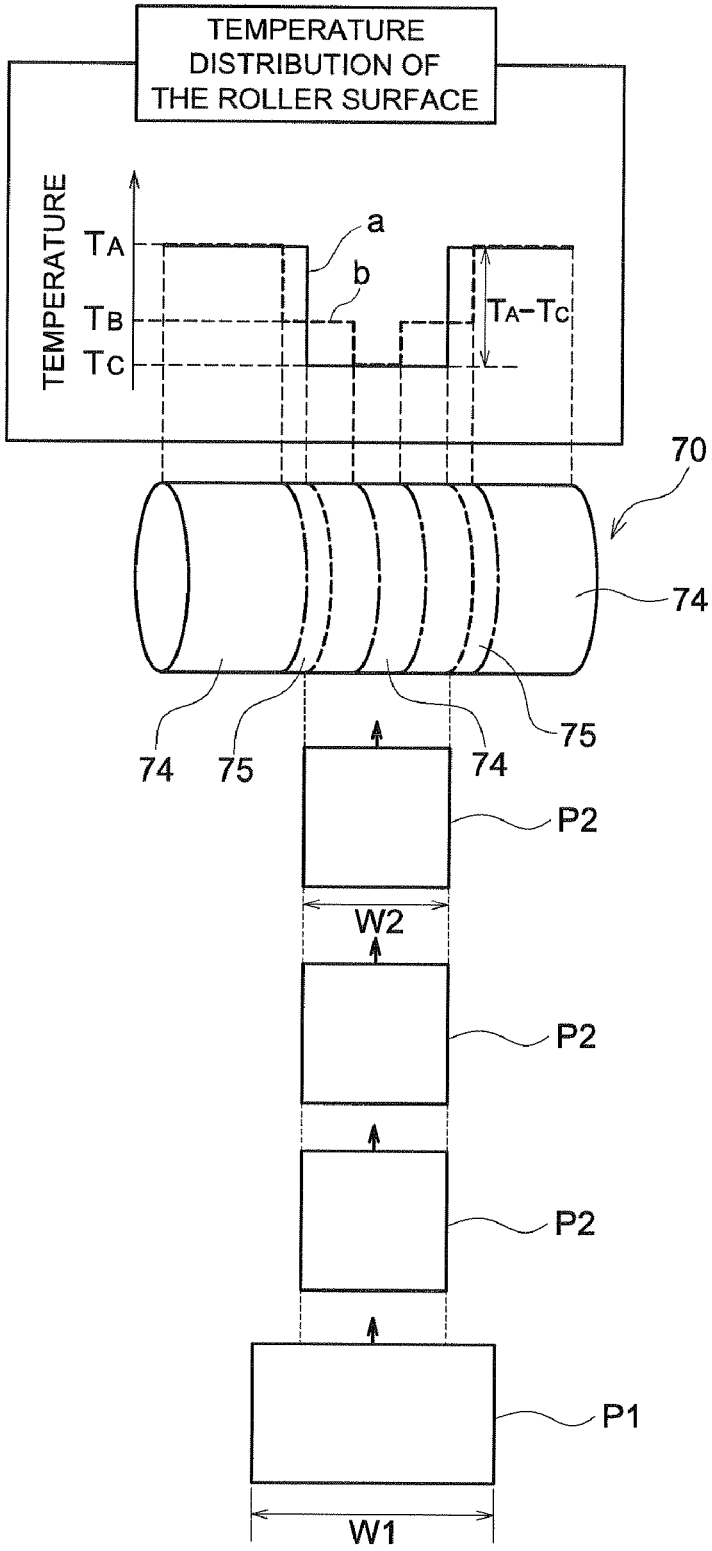
FIG. 3 is an illustrative view showing the surface temperature distribution b in a case in which small-width sheets are continuously passed through the heating roller of the fixing device according to the first embodiment of the present invention.

As shown in FIG. 3, the formation area of the carbon nanotube sheets 75 in the heating roller 70 includes the positions at which each edge of a sheet P2 with smaller width out of sheets of respective sizes (in the present embodiment, 2 sizes) passing through the heating roller 70; and is a belt-like area formed in the rotational direction of the heating roller 70. As shown in FIG. 3, each of the carbon nanotube sheets 75 is formed in the belt-like area ranging between the two positions which are a predetermined distance inside and outside of the position where on of the edges of the narrower sheet P2 contacts to the roller (illustrated with dashed lines on the circumferential surface of the heating roller 70). Herein, the upper carbon nanotube sheet 75 and the coating layer 74 are set so as to be flush with each other.

As shown in FIG. 4, these lower carbon nanotube sheet 72 and upper carbon nanotube sheet 73 each are thin-film sheet bodies in which a plurality of carbon nanotubes CNT are oriented such that the longitudinal directions of the CNT is parallel to each other. Herein, in the present embodiment, the longitudinal directions of carbon nanotube CNT groups contained in the lower carbon nanotube sheet 72 and the upper carbon nanotube sheet 73 are set to be at right angles to each other. Further, the longitudinal direction of the a carbon nanotube CNT group of the upper carbon nanotube 73 is preferably set to be parallel to the axial direction (main scanning direction) or the circumferential direction (vertical scanning direction) of the roller main body 71; or is preferably set in a direction in combination of the axial direction and the circumferential direction. In this manner, the orientation directions are set to intersect each other, whereby the carbon nanotube groups conduct heat in different direction, thereby facilitating the two-dimensional thermal homogeneity.

A carbon nanotube is a cylindrical substance of nano size, containing carbon atoms, featuring a diameter of 1-2 μm and a length of the axial direction of 100 μm-10 cm, and the maximum thermal conductivity of the axial direction is about 6000 W/mK. Incidentally, the thermal conductivity of gold (Au) is 300 W/mK, and the thermal conductivity of aluminum (Al) is 200 W/mK. A carbon nanotube exhibits excellent tensile strength and elasticity, as well as enhanced mechanical strength.

As shown in FIG. 2, the pressure roller 80 in the present embodiment has an elastic layer 82 exhibiting repulsive properties on the circumferential surface of the roller main body 81 and a coating layer 83 on the surface of the elastic layer 82. Herein, the pressure roller 80 is not limited to such a constitution.

The temperature distribution of the heating roller 70 surface will now be described with reference to FIG. 3. The solid line showing a temperature distribution in FIG. 3 represents the temperature distribution of the heating roller 70 surface in the case where sheets P2 are continuously fixed using a conventional heating roller in which a carbon nanotube sheet (a lower carbon nanotube sheet 72 or an upper carbon nanotube sheet 73) 75 is not introduced. Conventionally, no carbon nanotube sheet 75 was provided, whereby when sheets P2 with smaller width were continuously fixed, a rapid temperature drop of $T_A$ -$T_C$ was produced in the portions with which both edges of the sheets P2 were brought into contact.

In the present embodiment, carbon nanotube sheets 75 are arranged in the above positional relationship, whereby the temperature $T_B$ of the belt-like areas including the portions with which both edges of sheets P2 with smaller width are brought into contact does not rapidly drop, and thereby the temperature drop is reduced in the relationship of $T_A > T_B > T_C$, as shown with the dashed line b in FIG. 3. Therefore, even in the cases where sheets P2 with smaller width are continuously fixed, and then a sheet P1 with larger width is fixed, the temperature of the belt-like areas (carbon nanotube sheets 75) including the portions with which both edges of the sheets P2 are brought into contact in the previous step is not drastically decreased. Thereby, it is possible to reduce nonuniformity occurrence in the subsequent fixing step for the sheet P1.

Further, in the fixing device 17 according to the present embodiment, on the surface of the heating roller 70, a carbon nanotube sheet 75 only needs to be formed in an area for reducing the temperature drop, whereby the increase in the amount of a carbon nanotube CNT is managed, resulting in the possibility of substantial cost reduction.

(Second Embodiment)

Figure 6:
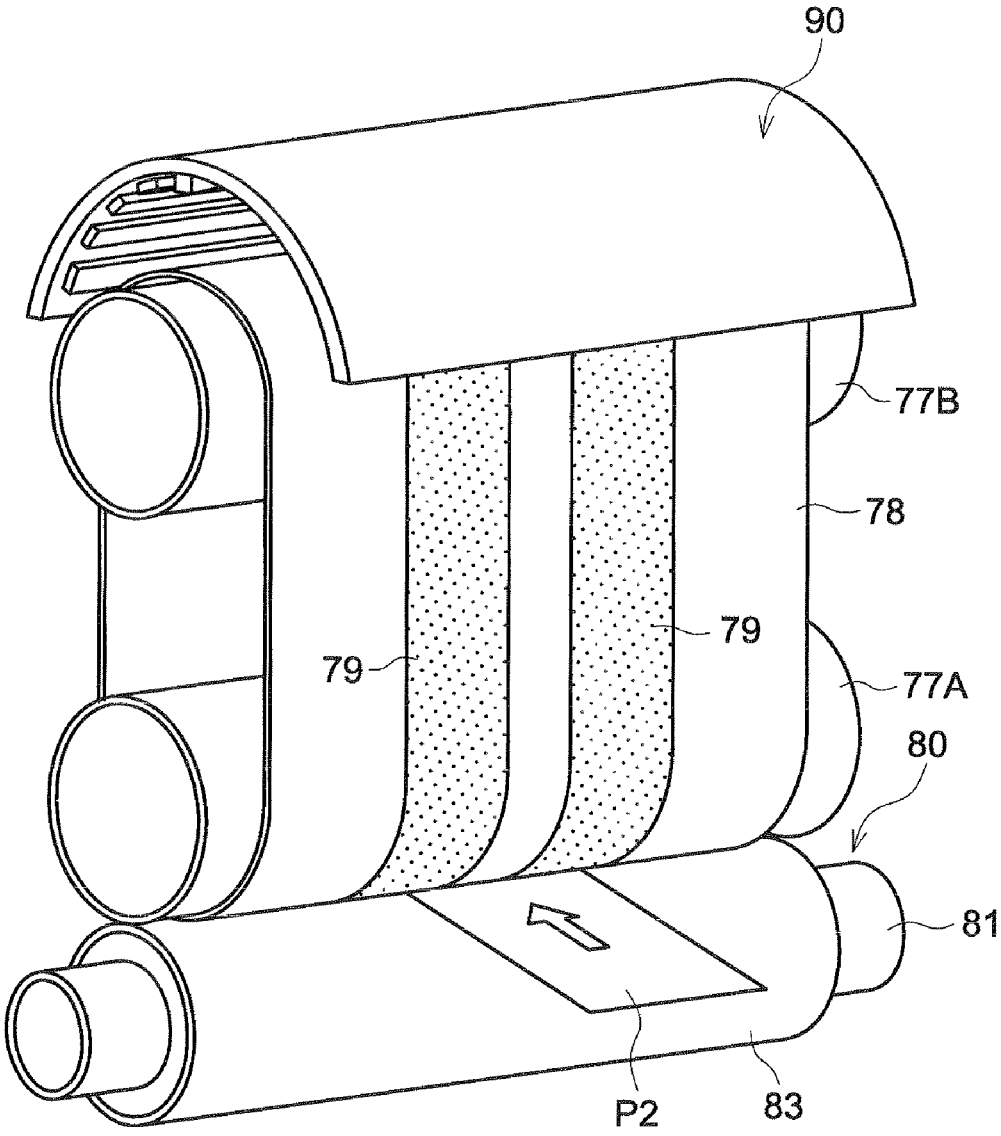
FIG. 6 is a perspective view of a fixing device according to a second embodiment of the present invention.

FIG. 6 is a perspective view of a fixing device according to a second embodiment of the present invention. The fixing device of the present embodiment employs a heating belt 78 instead of the heating roller 70 of the first embodiment. In the present embodiment, the pressure roller 80 is the same as in the first embodiment, and therefore the description thereof is omitted. Further, the fixing device according to the present embodiment can be applied to various types of image forming apparatuses such as a color copying machine similar to one in the first embodiment.

As shown in FIG. 6, in the present embodiment, the heating belt 78 is extended around a pair of parallel rollers 77A and 77B. Above the upper roller 77B, a belt heating member 90 to emit heat toward the heating belt 78 is placed opposed to the heating belt 78. On the outer surface of the heating belt 78, a pair of belt-like carbon nanotube sheets 79 provided with a large number of carbon nanotubes, whose longitudinal directions each are oriented in parallel, are placed with a space inbetween so as to circulate in the rotational direction (the vertical scanning direction). Herein, in the same manner as in the first embodiment, each of the arrangement areas of the carbon nanotube sheets 79 includes the position with which each edge of a sheet P2 in the transversal direction each is brought into contact, and this area is formed in a belt-like area ranging from a position a predetermined distance inside to a position a predetermined distance out side of from that contact position. Herein, the outer surface of the heating belt 78 including the carbon nanotube sheets 79 is set to be flush as a whole.

In the present embodiment, carbon nanotube sheets 75 are arranged for the heating belt 78, whereby temperature $T_B$ in the belt-like areas including the portions with which both edge of a sheet P2 with smaller width are brought into contact exhibits no rapid drop as shown with the dashed line b in FIG. 3. Thereby, uniformity is produced at temperature $T_B$ between temperature $T_A$ and temperature $T_C$. Therefore, when after continuous fixing of such sheets P2 with smaller width, a sheet P1 with larger width is fixed, the temperature of the belt-like areas (carbon nanotube sheets 79) including the portions with which both edges of the sheet P2 are brought into contact in the previous step is not drastically decreased. Thereby, it is possible to reduce nonuniformity in the fixing temperature when the sheet P1 is subsequently fixed.

Further, in the fixing device 17 according to the present invention, carbon nanotube sheets 79 need only to be provided only in areas whose rapid temperature drop should be reduced on the surface of the heating belt 78, whereby the increase of the amount of carbon nanotubes is reduced, resulting in limiting the cost increase.

Incidentally, also in the present embodiment, the carbon nanotube sheet 79 may be constituted in such a manner that a lower carbon nanotube sheet and an upper carbon nanotube sheet, in which a carbon nanotube group is oriented, are laminated so as for the individual orientation directions to intersect.

(Third Embodiment)

Figure 7:
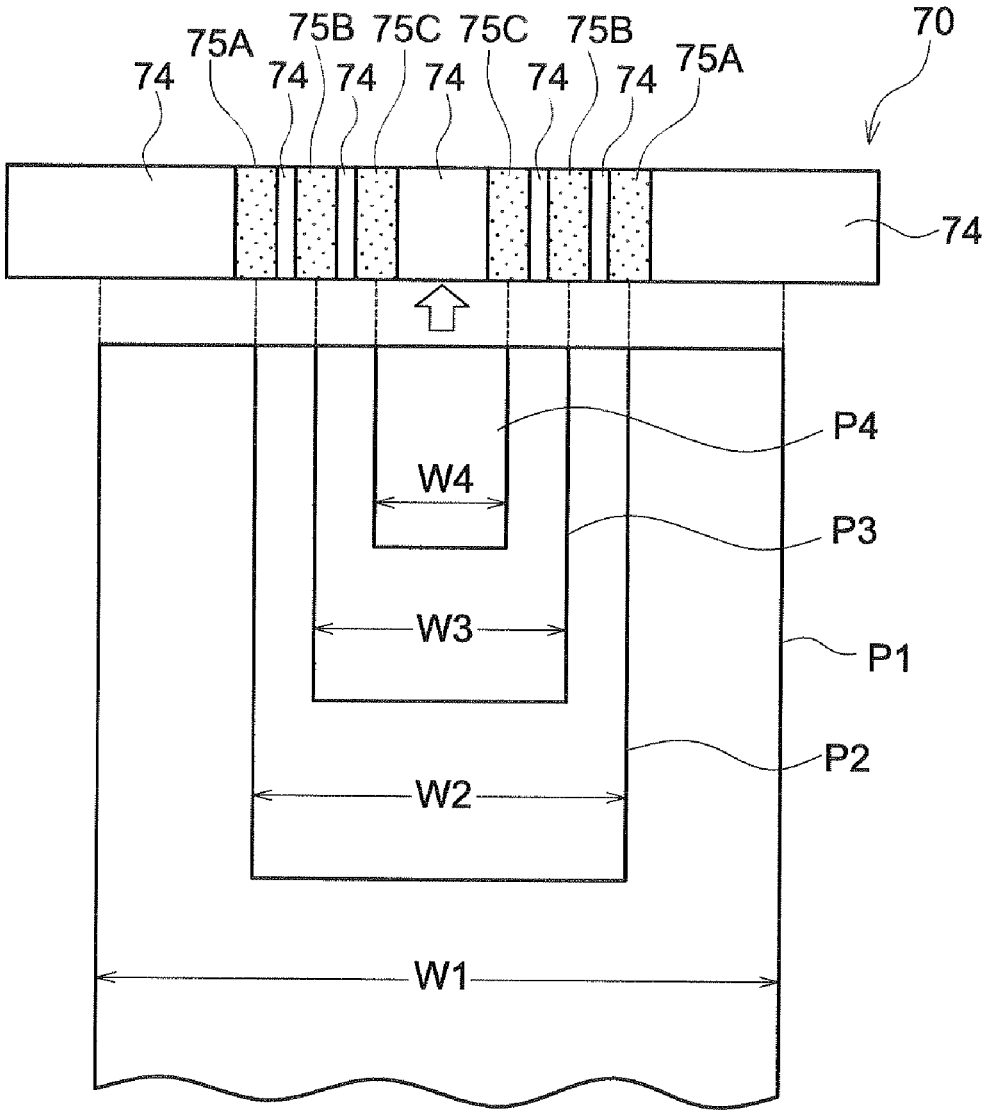
FIG. 7 is an illustrative view showing the heating roller of a fixing device according to a third embodiment of the present invention.

FIG. 7 is an illustrative view showing the heating roller 70 of a fixing device according to a third embodiment of the present invention. The fixing device according to the present embodiment can fix sheets of 4 kinds of size, namely a sheet P1 with the largest width W1 (e.g., A3 size sheet), a sheet P2 with the second largest width W2 (e.g., B4 size sheet), a sheet P3 with the third largest width W3 (e.g., A4 size sheet), and a sheet P4 with the fourth largest width W4 (e.g., B5 size sheet).

In the present embodiment, the pressure roller is the same as in the first embodiment. Therefore, the description thereof is omitted. Further, the fixing device of the present embodiment can be applied to various types of image forming apparatuses such as a color copying machine similar to one in the first embodiment As shown in FIG. 7, on the surface of the heating roller 70, provided are 3 pairs of belt-like carbon nanotube sheets 75A, 75A, 75B, 75B, 75C, and 75C; and belt-like coating layers 74 formed in areas other than these carbon nanotube sheets 75A, 75B, and 75C.

The carbon nanotube sheets 75A, 75B, and 75C are preferably constituted in such a manner that a lower carbon nanotube sheet 72 and an upper carbon nanotube sheet 73 each having the same width are sequentially laminated.

As shown in FIG. 7, each of the formation areas of a pair of the carbon nanotube sheets 75A and 75A in the heating roller 70 includes the position through which each of the edges of a sheet P2, of the sheets with respectively sizes (in the present embodiment, 4 sizes) to be supplied to the heating roller 70, with the second largest width passes; and ranges from the position a predetermined distance outside of and the position a predetermined distance inside of this position, and is a belt-like area formed in the rotational direction of the heating roller 70.

Further, each of the formation areas of a pair of the carbon nanotube sheets 75B and 75B in the heating roller 70 includes the position through which each of the edges of a sheet P3, of the four sizes of sheets to be supplied to the heating roller 70, with the third largest width passes; and ranges from the position a predetermined distance outside of and a predetermined distance inside this point, and is a belt-like area formed in the rotational direction of the heating roller 70.

Still further, each of the formation areas of a pair of the carbon nanotube sheets 75C and 75C in the heating roller 70 includes the position through which each of the edges of a sheet P4, of the four sizes of sheets to be supplied to the heating roller 70, with the fourth largest width passes; and ranges from the point a predetermined distance outside of and the point a predetermined distance inside of this point, and is a belt-like area formed in the rotational direction of the heating roller 70.

Coating layers 74 are provided in the spaces between the carbon nanotube sheets 75A, 75A, 75B, 75B, 75C, and 75C on the surface of the heating roller 70; and in the outer areas of the carbon nanotube sheets 75A and 75A in the heating roller 70. The carbon nanotube sheets 75A, 75A, 75B, 75B, 75C, and 75C and the coating layers 74 are provided so as to be flush with each other.

In the present embodiment, based on the above positional relationship, the carbon nanotube sheets 75A, 75A, 75B, 75B, 75C, and 75C are arranged, whereby in the same manner as in the first embodiment, temperature $T_B$ of the belt-like areas including the portions through which both edges of a sheet P2 of smaller width are brought into contact exhibits no rapid drop as shown with the dashed line b in FIG. 3. Thereby, uniformity is produced with temperature $T_B$ between temperature $T_A$ and temperature $T_C$. Therefore, when after continuous fixing of sheets P2 with smaller width, a sheet P1 of larger width is fixed, the temperature drop of the belt-like areas (carbon nanotube sheets 75A) including the portions through which both edges of the sheet P2 are brought into contact in the previous step is reduced. Thereby, it is possible to reduce nonuniformity occurrence in the subsequent fixing step for the sheet P1p.

In the fixing device 17 according to the present embodiment, when after continuous fixing of sheets P2, a sheet P1 with larger width than the sheet P2 is fixed, in the positions through which both edges of the sheet P2 pass, a rapid temperature drop can be reduced, whereby the fixing quality of the sheet P1 can be enhanced.

In the same manner, when after continuous fixing of sheets P3, a sheet P2 with larger width than the sheet P3 is fixed, in the positions through which both edges of the sheet P3 pass (in the areas of the carbon nanotube sheets 75B), a rapid temperature drop can be reduced, whereby the fixing quality of the sheet P2 can be enhanced. Further, when after continuous fixing of sheets P4, a sheet P3 with larger width than the sheet P4 is fixed, in the positions through which both edges of the sheet P4 pass (in the areas of the carbon nanotube sheets 75C), a rapid temperature drop can be reduced, whereby the fixing quality of the sheet P2 can be enhanced.

Further, also when after continuous fixing of sheets P4, sheets P2 and P1 are fixed, in the positions through which both edges of the sheet P4 pass (in the areas of the carbon nanotube sheets 75C), a rapid temperature drop can be reduced, whereby the fixing quality of the sheets P2 and P1 can be enhanced. Still further, when after continuous fixing of sheets P3, a sheet P1 is fixed, the fixing quality of the sheet P1 can be enhanced based on the same action and effect.

In the fixing device 17 according to the present embodiment, in addition to the above advantage, carbon nanotube sheets 75 only need to be formed only in areas whose rapid temperature drop should be reduced on the surface of the heating roller 70, whereby the increase of the amount of carbon nanotube CNT can be reduced, resulting in limiting the cost increase.

(Fourth Embodiment)

Figure 8:
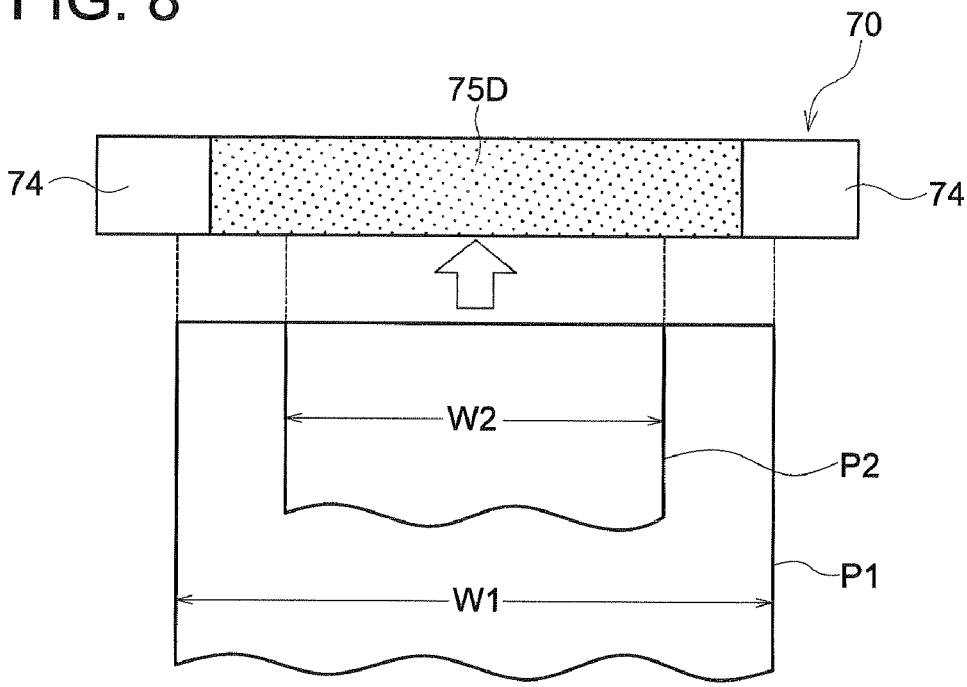
FIG. 8 is an illustrative view showing the heating roller of a fixing device according to a fourth embodiment of the present invention.

FIG. 8 is an illustrative view showing the heating roller 70 of a fixing device according to a fourth embodiment of the present invention. In the present embodiment, the pressure roller is the same as in the first embodiment. Therefore, the description thereof is omitted. Further, the fixing device of the present embodiment can be applied to various types of image forming apparatuses such as a color copying machine similar to one in the first embodiment.

As shown in FIG. 8, in the heating roller 70 according to the present embodiment, a carbon nanotube sheet 75D is entirely provided on the inner side of the position with which both edges of a sheet P1 with the largest width (e.g., A3 size sheet) each are brought into contact, and provided also on the inner side of the outer position by a predetermined distance of the position with which both edges of a sheet P2 with the second largest width (e.g., B4 size sheet) each are brought into contact. In the present embodiment, when after continuous fixing of any of sheets P3, P2, and P1 which have smaller widths than a sheet P1 having the largest acceptable width, a sheet of larger width than the continuously fixed sheet is fixed, the rapid temperature drop in the positions through which both edge sides of the continuously-fixed sheet passes can be reduced due to the high thermal conductivity of the carbon nanotube sheet 75D. Therefore, in-plane uniformity of heat which is transferred to a sheet to be fixed in the subsequent step can be enhanced, resulting in quality enhancement of fixing.

(Fifth Embodiment)

Figure 9:
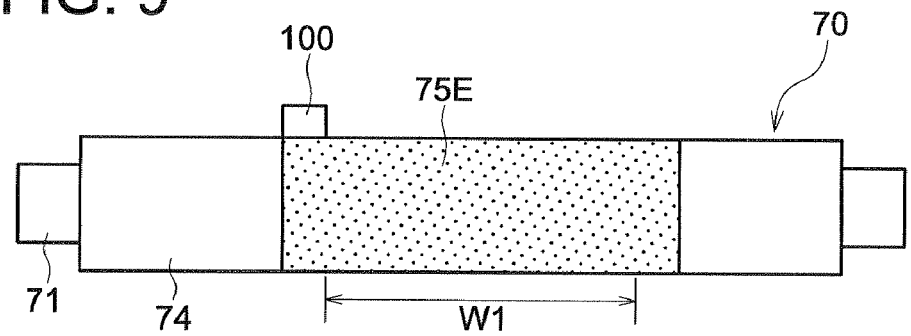
FIG. 9 is an illustrative view showing the heating roller of a fixing device according to a fifth embodiment of the present invention.

FIG. 9 is a front view showing the heating roller of a fixing device according to a fifth embodiment of the present invention. In the present embodiment, the arrangement area of a carbon nanotube sheet 75E formed on the surface of the heating roller 70 ranges from an inner side area of the position with which both edges of a sheet , of the acceptable sizes of sheets, with smaller width dimension than a sheet of the largest width dimension W1 each are brought into contact in the transverse direction to an outer side position by a predetermined distance from the position with which both edges of the sheet of the largest width dimension WI each are brought into contact in the transverse direction. Herein, in the present embodiment, in the heating roller 70, the carbon nanotube sheet 75E is arranged in the entire area positioned inside the outer side position by a predetermined distance from the position with which both edge sides of the sheet of the largest width dimension W1 each are brought into contact in the transverse direction.

Further, as shown in FIG. 9, in the present embodiment, a temperature sensor 100 is arranged, for the heating roller 70 surface, so as to be opposed to a part of the carbon nanotube sheet 75E in which the part is one extended toward the outside from the position with which one edge of a sheet with the largest width dimension W1 is brought into contact in the transverse direction. This temperature sensor 100 is a contact-type temperature sensor which is in contact with the carbon nanotube sheet 75E to detect the temperature of the heating roller 70 surface.

In the present embodiment, the carbon nanotube sheet 75E is extended to an outer side area from the position with which a side edge of a sheet P1 of the largest width dimension is brought into contact, whereby the temperature sensor 100 can be arranged on the outer side area, thereby resulting in accuracy enhancement of temperature detection for the inner side area. Since the temperature sensor is arranged in this position, the sensor is not interfered by sheets, and can be used is a contact-type temperature sensor which is in contact with the circular heating member to detect its temperature. In addition, the temperature of the sheet passing portion of a sheet of smaller width in the heating roller 70 can be detected by temperature detection of the non-sheet passing portion. Further, another advantage of the present embodiment is also the same as in the first embodiment.

Above described fixing device is preferably applied to any of an image forming apparatus such as a color copying machine according to the first embodiment, a B/W copying machine, and a color or B/W printer or facsimile machine, as well as a multifunction peripheral thereof. Therefore, in any of these image forming apparatuses, the detectivity of the temperature of a sheet passing area in the fixing device 17 can be enhanced. Accordingly, the present embodiment advantageously enhances detection accuracy of the temperature of the heating roller 70 surface, and thereby appropriately carrying out temperature control of the fixing device 17.

(Sixth Embodiment)

Figure 10:
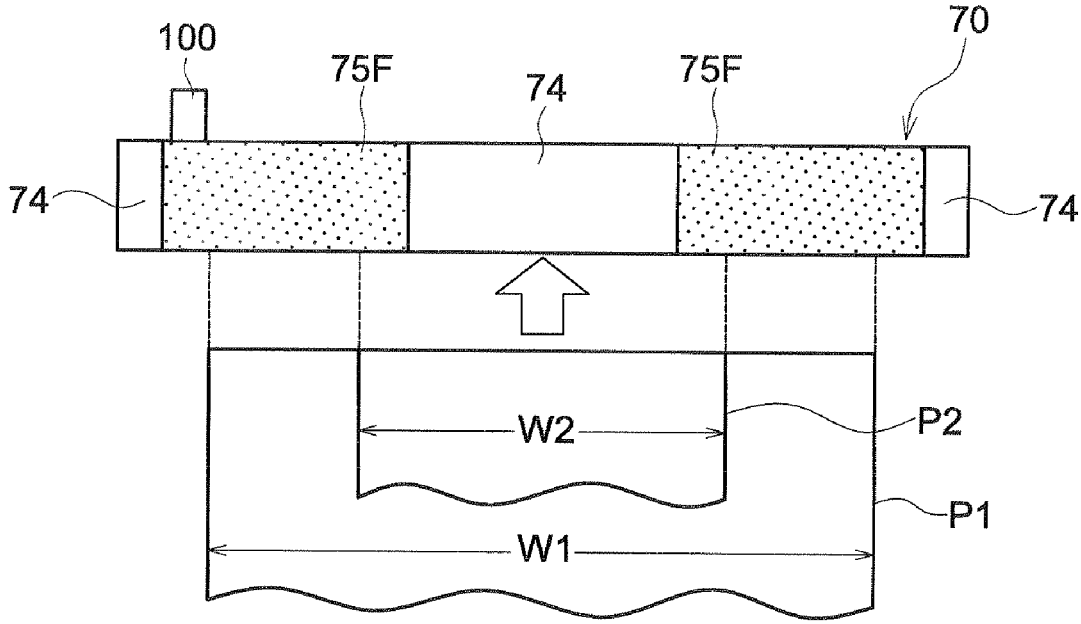
FIG. 10 is an illustrative view showing the heating roller of a fixing device according to a sixth embodiment of the present invention.

FIG. 10 is an illustrative view showing the heating roller 70 of a fixing device according to a sixth embodiment of the present invention. The fixing device of the present embodiment fixes sheets of two sizes, namely a sheet P1 with larger width dimension W1 and a sheet P2 with smaller width dimension.

In the present embodiment, the arrangement area of a carbon nanotube sheet 75F formed on the surface of the heating roller 70 ranges from an inner side position by a predetermined distance from the position with which both edges of a sheet, of the sheet to be passed through the fixing nip portion, with the smaller width dimension than a sheet of the largest width dimension W1 each are brought into contact in the transverse direction to an outer side position by a predetermined distance from the position with which both edge side positions of the sheet of the largest width dimension W1 each are brought into contact in the transverse direction.

Further, as shown in FIG. 10, in the present embodiment, a temperature sensor 100 is arranged, for the heating roller 70 surface, so as to be opposed to a part of the carbon nanotube sheet 75F in the part which is extended toward the outside from the position with which one edge of a sheet of the largest width dimension W1 is brought into contact in the transverse direction. This temperature sensor 100 is a contact-type temperature sensor which is in contact with the carbon nanotube sheet 75F to detect the temperature of the heating roller 70 surface.

In the present embodiment, the carbon nanotube sheet 75F is extended to an outer side area from the position with which a side edge of a sheet P1 of the largest width dimension is brought into contact, whereby the temperature sensor 100 can be arranged in such an outer side area, resulting in accuracy enhancement of temperature detection for the inner side area. Further, another advantage of the present embodiment is also the same as in the first embodiment.

(Seventh Embodiment)

Figure 11:
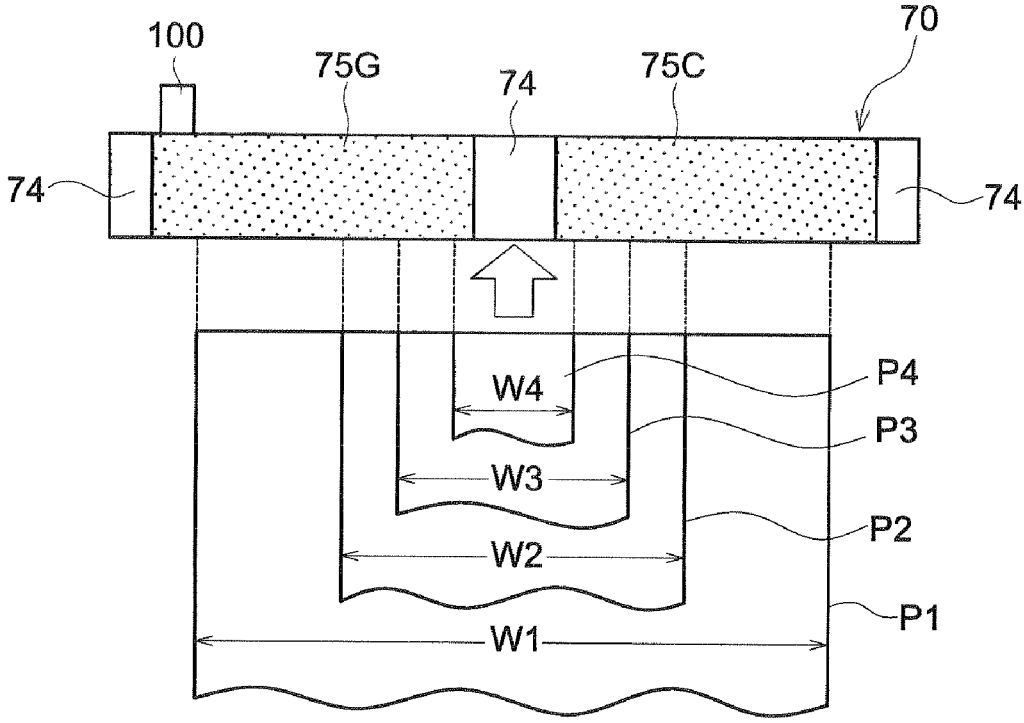
FIG. 11 is an illustrative view showing the heating roller of a fixing device according to a seventh embodiment of the present invention.

A fixing device according to the present embodiment fixes sheets of 4 sizes P1, P2, P3, and P4 as shown in FIG. 11.

In the present embodiment, the arrangement area of a carbon nanotube sheet 75G formed on the surface of the heating roller 70 ranges from an inner side position by a predetermined distance from the position with which each of the both edge sides of a sheet P4 with the smallest width dimension W4 of the sheets several sizes to be passed through the fixing nip portion is brought into contact in the transverse direction to an outer side position by a predetermined distance from the position with which each of the both edge sides of a sheet P1 with the largest width dimension W1 is brought into contact in the transverse direction.

Further, as shown in FIG. 11, in the present embodiment, a temperature sensor 100 is arranged, for the heating roller 70 surface, so as to be opposed to a part of the carbon nanotube sheet 75G in which the part is one extended to the outside from the position with which each of the both edge sides of a sheet of the largest width dimension W1 is brought into contact in the transverse direction. This temperature sensor 100 is a contact-type temperature sensor which is in contact with the carbon nanotube sheet 75G to detect the temperature of the heating roller 70 surface.

In the present embodiment, the carbon nanotube sheet 75G is extended toward an outer side area from the position with which a side edge of a sheet P1 with the largest width dimension is brought into contact, whereby the temperature sensor 100 can be arranged an outer side area, thereby resulting in accuracy enhancement of temperature detection for the inner side areas (areas through which the sheets P1-P4 are passed). Further, another advantage of the present embodiment is also the same as in the first embodiment Such a fixing device is preferably applied to any of an image forming apparatus such as a color copying machine according to the first embodiment, a B/W copying machine, and a color or B/W printer or facsimile machine, as well as a multifunction peripheral thereof. Therefore, in any of these image forming apparatuses, the detectivity of the temperature of a sheet passing area in the fixing device 17 can be enhanced. Accordingly, the present embodiment enhances detection accuracy of the temperature of the heating roller 70 surface, and thereby appropriately carrying out temperature control of the fixing device 17.

(Another Embodiment)

The first-seventh embodiments have been described. However, the descriptions and drawings constituting a part of this disclosure should not be considered to limit the scope of this invention. According to the disclosure, various alternative embodiments, examples, and working technologies could become clear to those in the art.

For example, in the present embodiment, a carbon nanotube sheet was provided on the heating roller 70 side or the heating belt 78 as a carbon nanotube group. However, such a carbon nanotube sheet may be formed in the same area as in the above embodiment also on the pressure roller.

Further, also in the third-seventh embodiments, as a carbon nanotube sheet, a plural-layer structured sheet, in which a lower carbon nanotube sheet and an upper carbon nanotube sheet are laminated, is preferably used.

Figure 12:
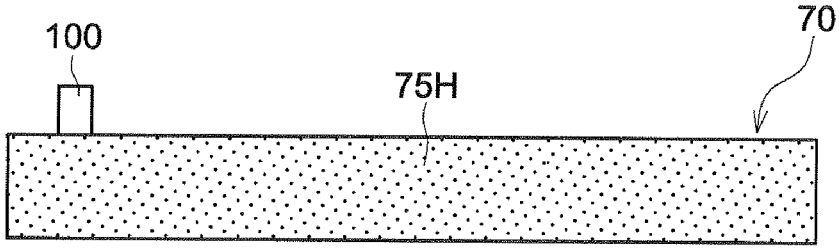
FIG. 12 is a side view showing another embodiment of the present invention.

Still further, in each of the embodiments, a carbon nanotube sheet was partially arranged in the heating roller 70 or the heating belt 78. However, as shown in FIG. 12, a constitution of placing a carbon nanotube sheet 75H, in which a plurality of carbon nanotubes are oriented, on the entire surface of the heating roller also falls within the applicable scope of the present invention.

Yet further, in each of the embodiments, description was made on the case in which sheets of a plurality of different sizes were passed in such an arrangement manner that the center lines thereof coincide with each other. However, the present invention is also preferably applied to the case in which sheet passing is carried out such that one edge portion of each of the sheets with different sizes coincide in the transverse direction. In that manner, even in the case where after continuous fixing of sheets with smaller width dimension, a sheet with larger width dimension is fixed, nonuniformity occurrence in fixing of the sheet of larger width dimension can be reduced.

What is claimed is:

1. A fixing device comprising:

a pair of fixing circular members for conveying a sheet while pinching the sheet between a fixing nip formed between the fixing circular members, and fixing, by heating, an unfixed toner image formed on the sheet onto the sheet, at least one of the circular member being a circular heating member on an outer circumferential surface of which is provided with a first carbon nanotube group which is made of a plurality of carbon nanotubes oriented in one of the following direction: a rotation axis direction of the circular heating member; a circumferential direction of the circular heating member, and a combined direction of the rotation axis direction and the circumferential direction.

2. The fixing device of claim 1, wherein the fixing nip is configured to be supplied with at least two sizes of sheets, a first sheet feeding area on the circular heating member where a sheet having a wider width touches the circular heating member and a second sheet feeding area on the circular heating member where a sheet having a narrower width touches the circular heating member overlap each other, and an area where the carbon nanotube group is disposed includes an internal portion of both edges of the first sheet feeding area and an internal area of both edges of the second sheet feeding area.

3. The fixing device of claim 1, wherein the fixing nip is configured to be supplied with at least two sizes of sheet, a first sheet feeding area on the circular heating member where a sheet with a wider width touches the circular heating member and a second sheet feeding area on the circular heating member where a sheet having a narrower width touches the circular heating member overlap each other, and an area where the carbon nanotube group is disposed includes an external portion of both edges of the first sheet feeding area and an internal area of both edges of the second sheet feeding area.

4. The fixing device of claim 3, comprising:

a temperature sensor provided for detecting temperature of the circular heating member such that the temperature sensor is arranged to face the carbon nanotube group outside of the first sheet feeding area.

5. The fixing device of claim 4, wherein the temperature sensor is a contact-type temperature sensor which is in contact with the circular heating member to detect temperature.

6. The fixing device of claim 5, wherein the first carbon nanotube group and the second carbon nanotube group are stacked one on the other on the outer circumferential surface of the circular heating member.

7. The fixing device of claim 1, comprising:

a second carbon nanotube group which is provided on the circular heating member and is made of a plurality of carbon nanotubes oriented in a direction different from the orientation direction of first carbon nanotube group.

8. The fixing device of claim 6, wherein in one of the first carbon nanotube group and the second carbon nanotube group a longitudinal direction of the carbon nanotubes are parallel to the rotation axis of the circular heating member, and in the other carbon nanotube group the longitudinal direction of the carbon nanotubes is parallel to a circumferential direction of the circular heating member.

9. An image forming apparatus, comprising:

a photoreceptor for carrying thereon an electrostatic latent image;

a developing section for developing the electrostatic latent image on the photoreceptor with toner to form a toner image;

a transfer section for transferring the toner image onto a sheet;

a fixing device for fixing the toner image onto the sheet, the fixing device including:

a pair of fixing circular members for conveying the sheet while pinching the sheet between a fixing nip formed between the fixing circular members, and fixing, by heating, the toner image formed on the sheet onto the sheet, at least one of the circular member being a circular heating member on an outer circumferential surface of which is provided with a first carbon nanotube group which is made of a plurality of carbon nanotubes oriented in one of the following direction: a rotation axis direction of the circular heating member; a circumferential direction of the circular heating member, and a combined direction of the rotation axis direction and the circumferential direction.

* * * * *